US006769387B2

(12) United States Patent
Hayman et al.

(10) Patent No.: US 6,769,387 B2
(45) Date of Patent: Aug. 3, 2004

(54) COMPACT TWO-STEP ROCKER ARM ASSEMBLY

(75) Inventors: Alan W. Hayman, Romeo, MI (US); Eric C. Douse, Pontiac, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/649,217

(22) Filed: Aug. 26, 2003

(65) Prior Publication Data

US 2004/0074459 A1 Apr. 22, 2004

Related U.S. Application Data

(60) Provisional application No. 60/419,443, filed on Oct. 19, 2002.

(51) Int. Cl.[7] ..... F01L 1/18

(52) U.S. Cl. ..... 123/90.39; 123/90.4; 123/90.44; 123/90.46

(58) Field of Search ..... 123/90.39, 90.4, 123/90.41, 90.43, 90.44, 90.45, 90.46; 74/559, 567, 568 R, 569

(56) References Cited

U.S. PATENT DOCUMENTS

| | | | | | |
|---|---|---|---|---|---|
| 4,151,817 | A | | 5/1979 | Mueller | 123/90.16 |
| 4,203,397 | A | | 5/1980 | Soeters, Jr. | 123/90.16 |
| 4,768,467 | A | * | 9/1988 | Yamada et al. | 123/90.16 |
| 5,452,694 | A | * | 9/1995 | Hara | 123/90.16 |
| 5,544,626 | A | * | 8/1996 | Diggs et al. | 123/90.16 |
| 5,655,488 | A | | 8/1997 | Hampton et al. | 123/90.16 |
| 6,439,179 | B2 | | 8/2002 | Hendriksma et al. | 123/90.16 |
| 6,532,920 | B1 | | 3/2003 | Sweetnam et al. | 123/90.16 |
| 6,588,387 | B2 | * | 7/2003 | Cecur | 123/90.48 |

* cited by examiner

*Primary Examiner*—Thomas Denion
*Assistant Examiner*—Ching Chang
(74) *Attorney, Agent, or Firm*—Leslie C. Hodges; Karl F. Barr, Jr.

(57) ABSTRACT

A rocker arm assembly includes an inner rocker arm and an outer rocker arm. The outer rocker arm includes two rail portions spaced a distance apart and forming an open space therebetween. The inner rocker arm is pivotably connected to the outer rocker arm such that it is at least partially within the open space. The inner rocker arm includes a locking pin housing containing two locking pins selectively engageable with holes in each of the rail portions to selectively prevent relative movement between the inner rocker arm and the outer rocker arm. The rocker arm assembly enables two-step valve operation and has a design characterized by compact size and improved manufacturability.

20 Claims, 5 Drawing Sheets

COMPACT TWO-STEP ROCKER ARM ASSEMBLY

CROSS REFERENCE TO RELATED APPLICATION

This application claims the benefit of U.S. Provisional Application 60/419,443, filed Oct. 19, 2002, which is hereby incorporated by reference in its entirety.

TECHNICAL FIELD

This invention relates to a dual-mode valvetrain for an internal combustion engine.

BACKGROUND OF THE INVENTION

Prior art valvetrains include valvetrains that are selectively adjustable to vary the amount of valve travel during opening. Typically, such valvetrains are selectively adjustable between a low-lift mode, in which the valvetrain causes a valve to open a first predetermined amount, and a high-lift mode, in which the valvetrain causes the valve to open a second predetermined amount that is greater than the first predetermined amount. Such dual mode, or "two step," valvetrains are significantly larger than comparable valvetrains that are not adjustable, often resulting in incompatibility with existing engine designs without significant modification to the cylinder head design. Furthermore, such prior art valvetrains are complex, with resultant manufacturing and assembly inefficiencies.

SUMMARY OF THE INVENTION

A rocker arm assembly for a valvetrain is provided. The rocker arm assembly includes an outer rocker arm characterized by two longitudinally-oriented rail portions spaced a distance apart from one another and defining an open space therebetween. An inner rocker arm is pivotably mounted with respect to the outer rocker arm such that at least a portion of the inner rocker arm is in the open space between the two rail portions of the outer rocker arm. The inner rocker arm has a cam follower thereon for engagement with a low-lift cam, and each of the rail portions of the outer rocker arm has a cam follower thereon for engagement with a high-lift cam.

A locking pin housing on the inner rocker arm has a transversely-oriented locking pin bore formed therein. A first locking pin and a second locking pin are translatable within the bore and selectively movable between an extended position in which they extend into locking pin holes in the outer rocker arm rail portions thereby to prevent relative movement between the inner rocker arm and the outer rocker arm, and a retracted position in which they do not extend into the locking pin holes in the outer rocker arm rail portions.

Thus, the outer rocker arm and the inner rocker arm may move together as a single unit or may move independently of one another within certain constraints, allowing for two discrete valve events on any given inlet or exhaust valve. More specifically, when the inner rocker arm and the outer rocker arm move independently, the inner rocker arm is configured to open and close a valve according to the geometry of a low-lift cam; when the inner rocker arm and the outer rocker arm are locked, the rocker arm assembly is configured to open and close the valve according to the geometry of a high-lift cam. Adjustability of the valve opening allows for engine operating benefits such as improved idle, increased volumetric efficiency, improved combustion performance, reduced fuel consumption due to a variation in the valve timing events caused by the improved combustion performance, and reduced fuel consumption due to a variation in the valve timing events caused by the camshaft which may be controlled by a camshaft phaser, and reduced emissions due to the ability for each of the inlet valves to be lifted differing amounts causing an increase in cylinder air motion. The rocker arm assembly may be employed with both inlet valves and exhaust valves.

The above features and advantages, and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
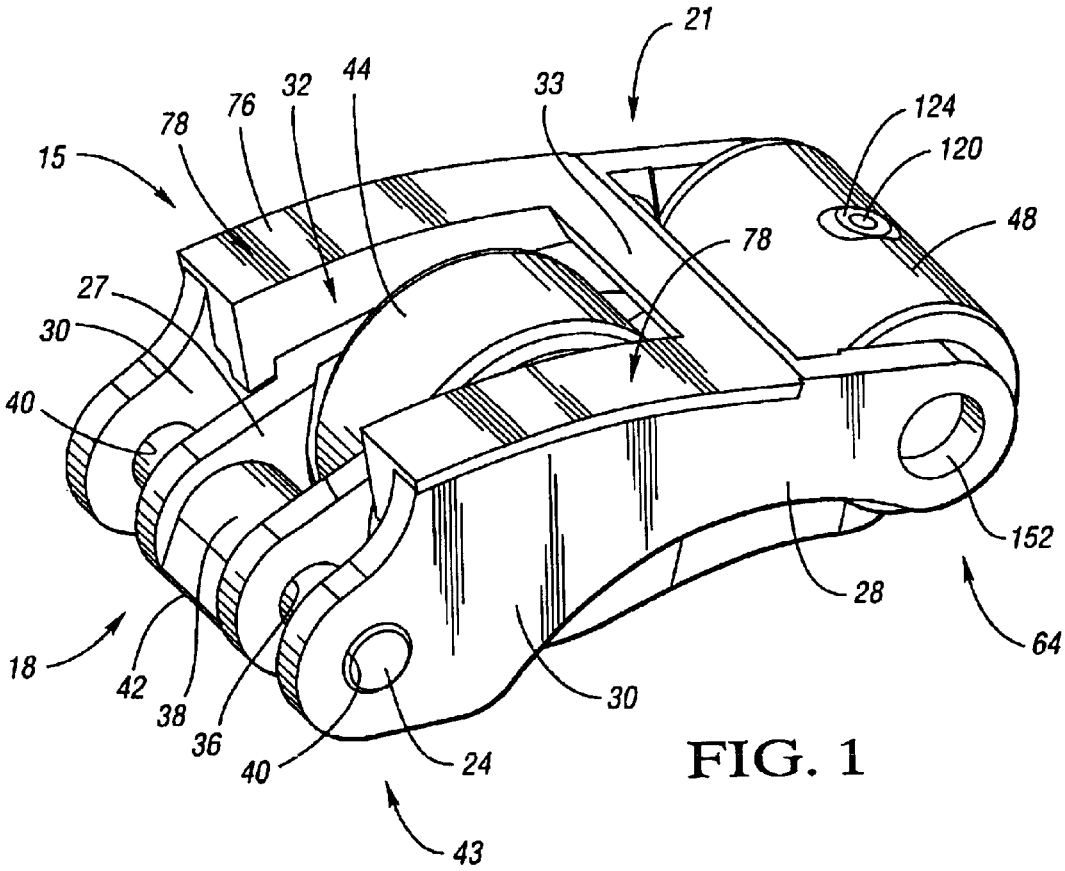
FIG. 1 is a schematic top perspective view from one end of a rocker arm assembly with a torsion spring removed for clarity.

Referring to FIG. 1, a rocker arm assembly 15 is schematically depicted. The rocker arm assembly 15 includes an inner rocker arm assembly 18 and an outer rocker arm assembly 21 which are pivotably joined by a shaft 24. The inner rocker arm assembly 18 includes an inner rocker arm 27; the outer rocker arm assembly 21 includes an outer rocker arm 28 characterized by two rail portions 30 longitudinally oriented with respect to the rocker arm assembly 15, spaced a distance apart from one another, and forming an open space 32 therebetween. An upper tie bar portion 33 of the outer rocker arm 28 interconnects the two rail portions 30. The inner rocker arm 27 and the outer rocker arm 28 are preferably investment cast. The inner rocker arm assembly 18 is at least partially located within the open space 32.

The shaft 24 is press fitted into an aperture 36 in the inner rocker arm 27 through a pivot shaft retention boss 38 that is a unitary part of the inner rocker arm 27. The shaft 24 has a close, but non-interference fit, through apertures 40, or bores, in each of the rail portions 30 of the outer rocker arm. The inner rocker arm 27 includes a valve stem contact pad 42 at a first end 43 adjacent to the pivot shaft 24 and the pivot shaft retention boss 38. The press fit design for the rocker arm pivot shaft 24 allows for a traditional valve to rocker arm interface by virtue of the geometry at the valve contact pad 42. Alternatively, the pivot shaft 24 may be press fitted into outer rocker arm apertures 40 and have a close, but non-interference fit, through aperture 36 in the inner rocker arm 27.

The inner rocker arm assembly 18 also includes a roller element cam follower 44 (although it could be a sliding interface at the expense of increased friction) located in an opening defined by the inner rocker arm 27. The inner rocker arm 27 also includes a locking pin housing 48 which houses locking pins, as depicted at 92 in FIGS. 8 and 9, used to selectively prevent relative motion between the inner rocker arm assembly 18 and the outer rocker arm assembly 21.

Figure 2:
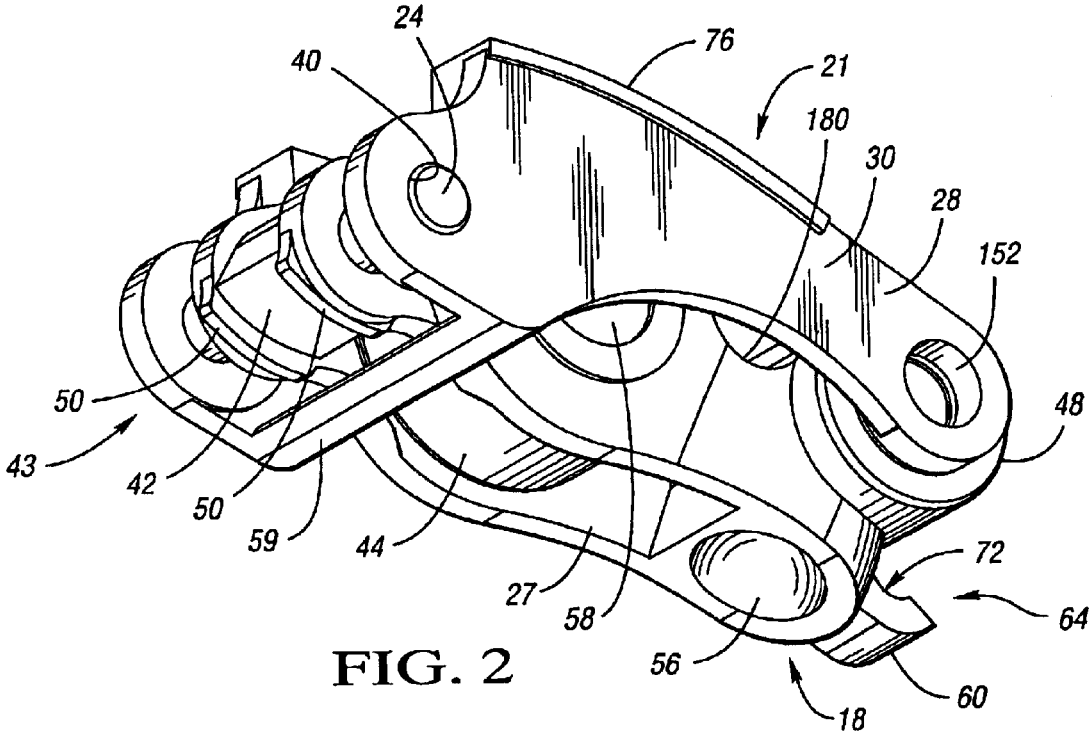
FIG. 2 is a schematic bottom perspective view of the rocker arm assembly of FIG. 1.
Figure 12:
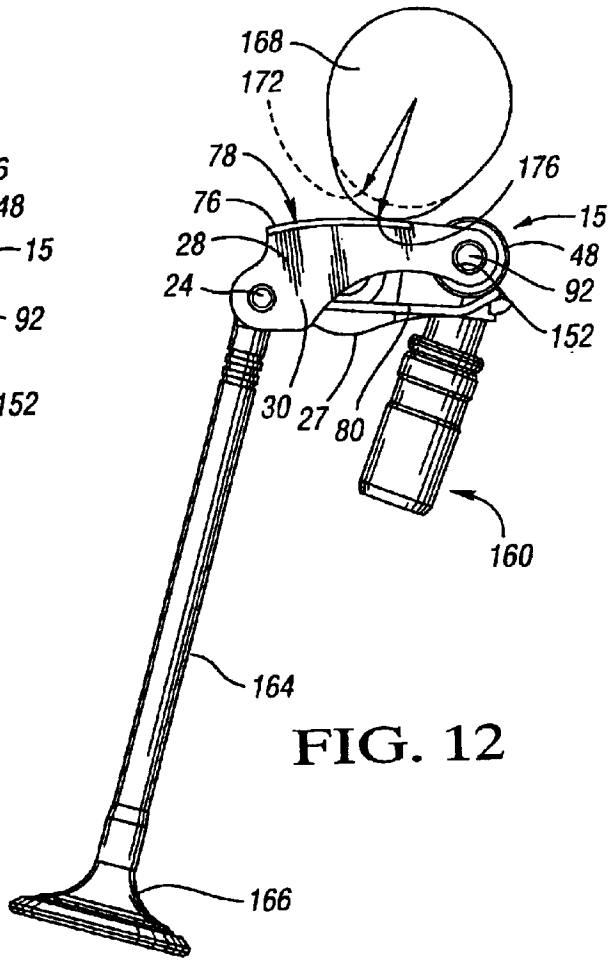
FIG. 12 is a schematic side elevational view of the valvetrain of FIGS. 10 and 11 with the rocker arm assembly in a high-lift valve open position.
Figure 11:
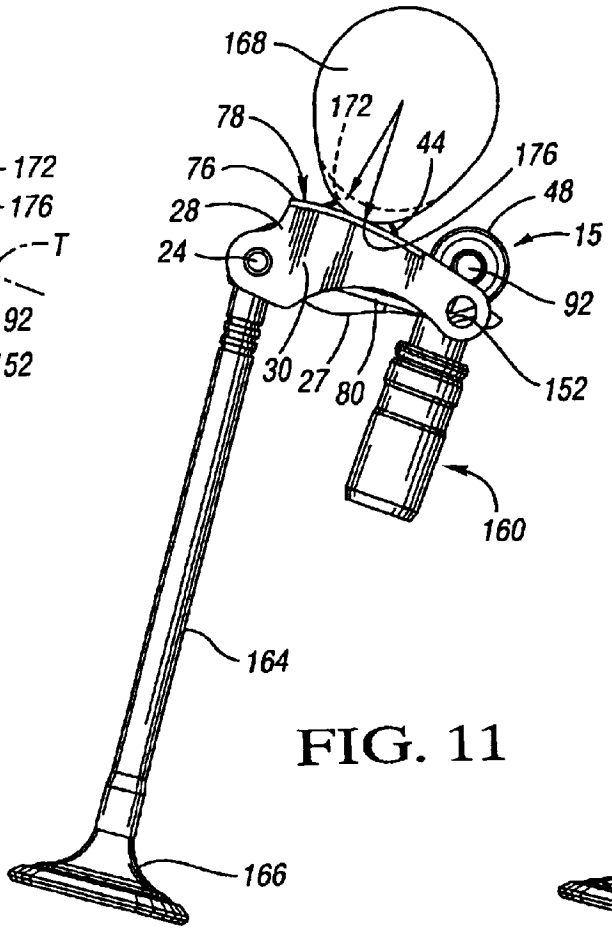
FIG. 11 is a schematic side elevational view of the valvetrain of FIG. 10 with the rocker arm assembly in a low-lift valve open position.
Figure 10:
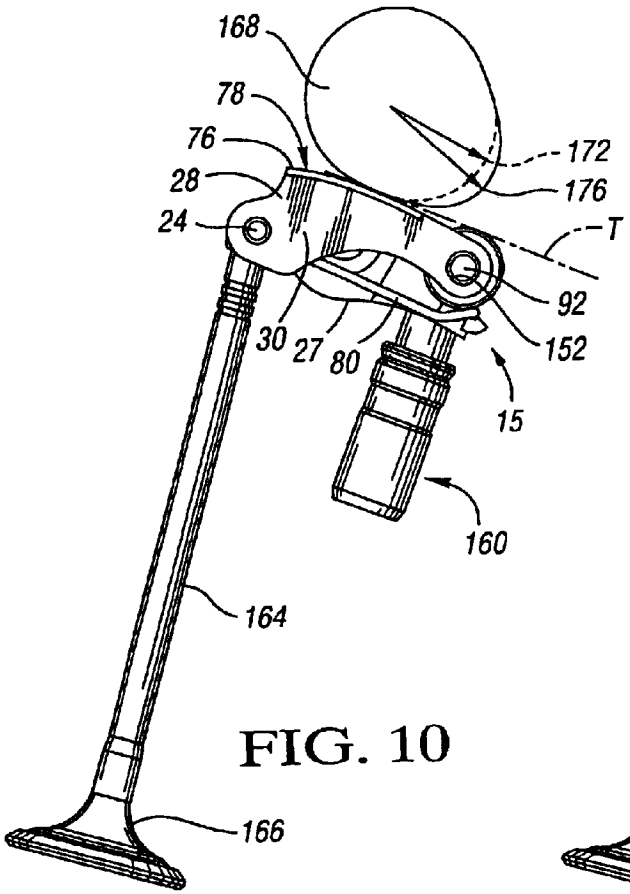
FIG. 10 is a schematic side elevational view of a valvetrain having the rocker arm assembly of FIG. 1 in a valve closed position.

Referring to FIG. 2, the inner rocker arm 27 also includes a valve stem guide ear 50 on each side of the valve contact pad 42. The inner rocker arm 27 also defines a cavity 56 into which a portion of a hydraulic lash adjuster, as depicted at 160 in FIGS. 10–12, is insertable and about which the inner rocker arm is pivotable. The cavity 56 thus acts as a pivot interface, sometimes referred to as a "pivot pocket." The outer rocker arm 28 includes a lower tie bar portion 59 that interconnects the rail portions 30. Within the scope of the claimed invention, rail portions and tie bars may or may not be part of a one-piece outer rocker arm. For example, the rail portions, upper tie bar portion, and lower tie bar portion may be separate members rigidly connected to one another to form the outer rocker arm.

Figure 3:
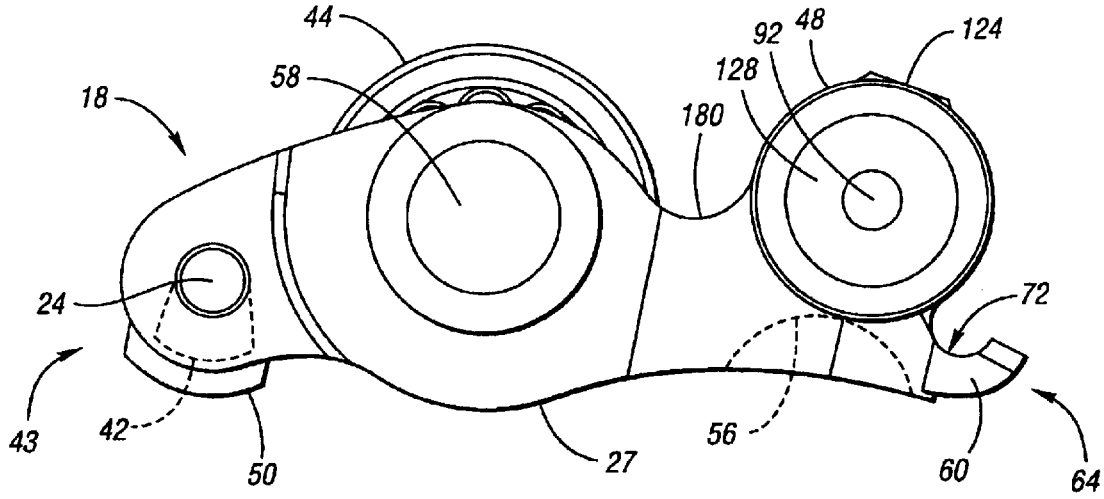
FIG. 3 is a schematic side view of the inner rocker arm assembly of the rocker arm assembly of FIG. 1.

Referring to FIG. 3, the roller element cam follower 44 is configured for engagement with a low-lift cam, as depicted at 172 in FIGS. 10–12, which contacts the roller and causes the inner rocker arm assembly 18 to pivot about the lash adjustor at the pivot interface 56. The roller element cam follower 44 is rotatable with respect to the inner rocker arm on an axle 58. The inner rocker arm 27 further includes a curved protrusion 60 at a second end 64 opposite the first end 43 and adjacent the pivot interface 56. The curved protrusion 60 includes a concave surface 72 that forms a concavity. The curved protrusion 60 is a saddle for a "lost motion" spring, as depicted at 80 in FIGS. 4–7.

Figure 4:
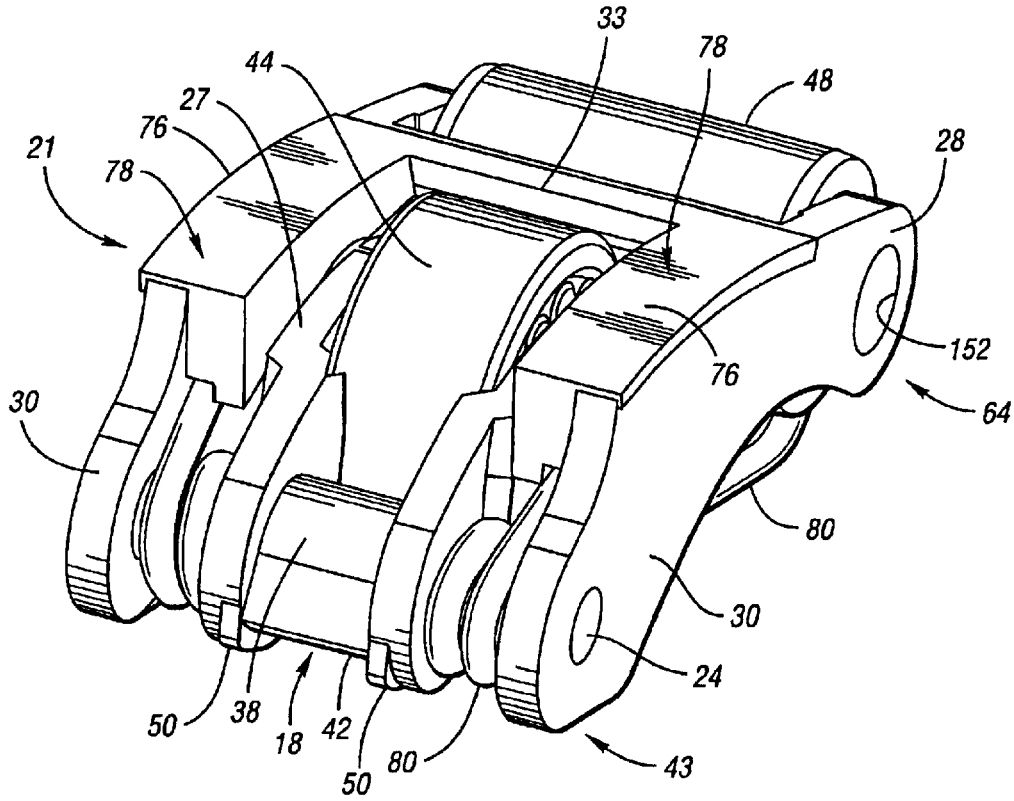
FIG. 4 is another schematic top perspective view of the rocker arm assembly of FIG. 1 with the torsion spring included.

Referring to FIG. 4, the outer rocker arm assembly 21 includes a camshaft interface pad 76 as a cam follower on each rail portion 30. The camshaft interface pads 76 may or may not be unitary parts of the outer rocker arm 28. The camshaft interface pads 76 include surfaces 78 configured for contact with a pair of "high lift" cams, as depicted at 176 in FIGS. 10–12, that are on each side of a "low lift" cam that runs in contact with the roller element 44.

Figure 5:
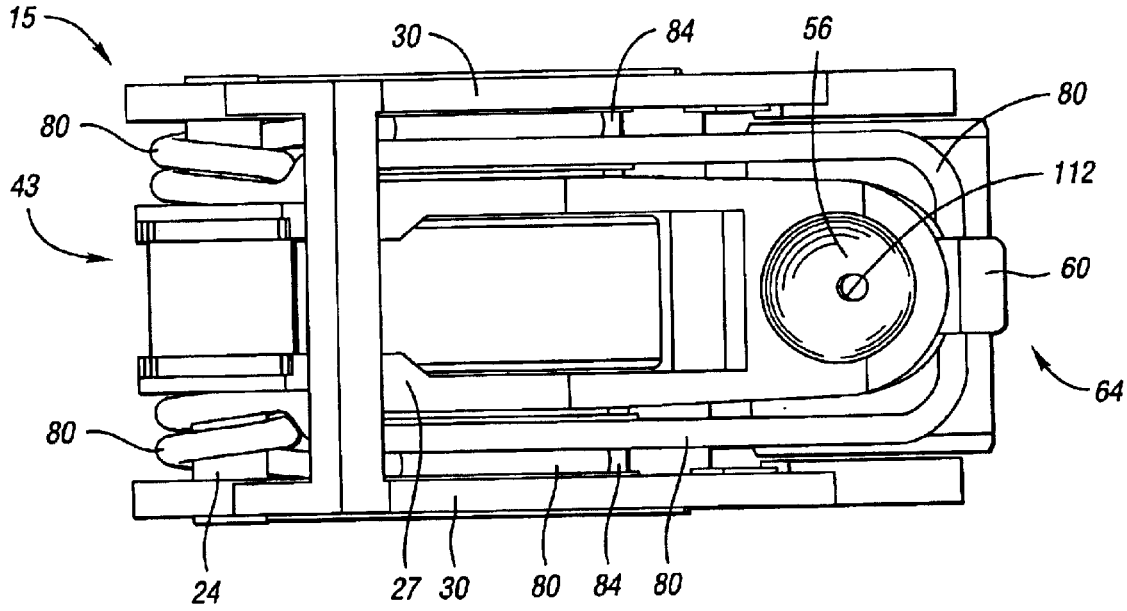
FIG. 5 is a schematic bottom view of the rocker arm assembly of FIG. 1 with the torsion spring included.

Referring to FIG. 5, the concavity formed by protrusion 60 positively locates the "lost motion" torsion spring 80 with respect to the inner arm 27, and the concave surface on the protrusion 60 acts as a reaction surface against which the torsion spring 80 is biased. The torsion spring 80 extends longitudinally with respect to the rocker arm assembly along two sides of the inner rocker arm 27, winds about the pivot shaft 24 between the inner rocker arm 27 and each of the two rail portions 30, and contacts the underside surface 84 of the high lift camshaft interface pads. The pivot shaft 24 is a support axis for the spring 80. The spring 80 is biased against the underside surface 84, exerting a force that maintains the interface pads and their contact surfaces in contact with the high-lift cams. This compact spring design improves the packagability of the rocker arm assembly 15.

Figure 6:
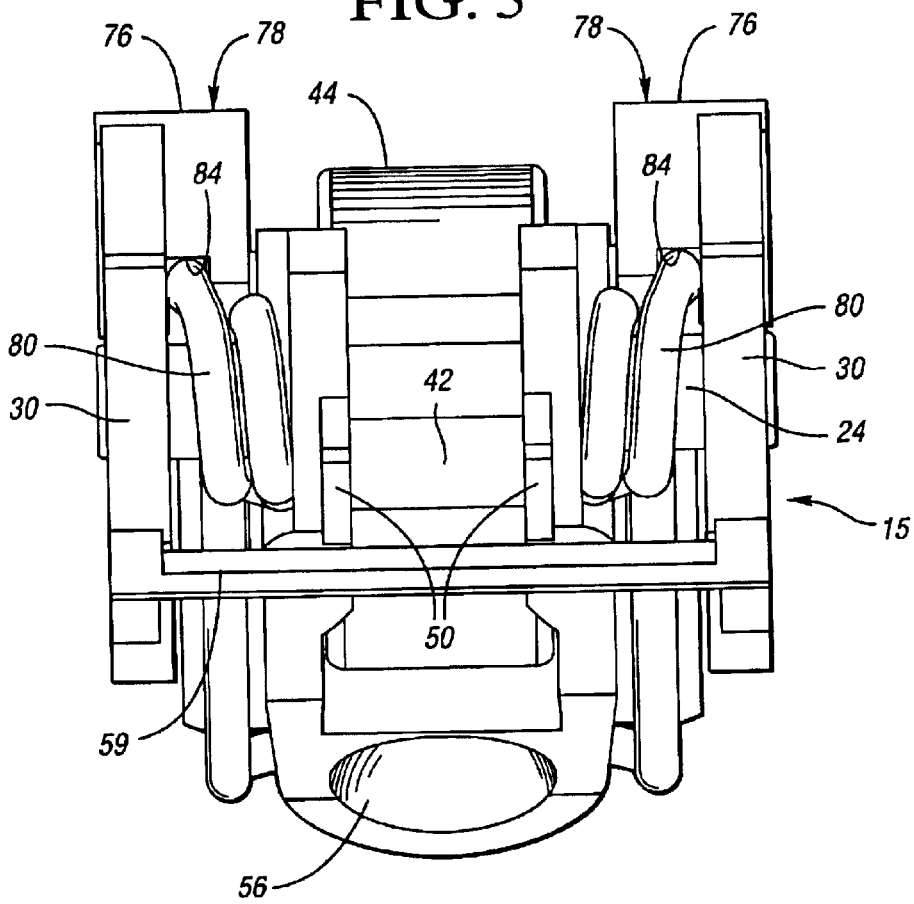
FIG. 6 is a schematic front view of the rocker arm assembly of FIG. 1 with the torsion spring included.
Figure 7:
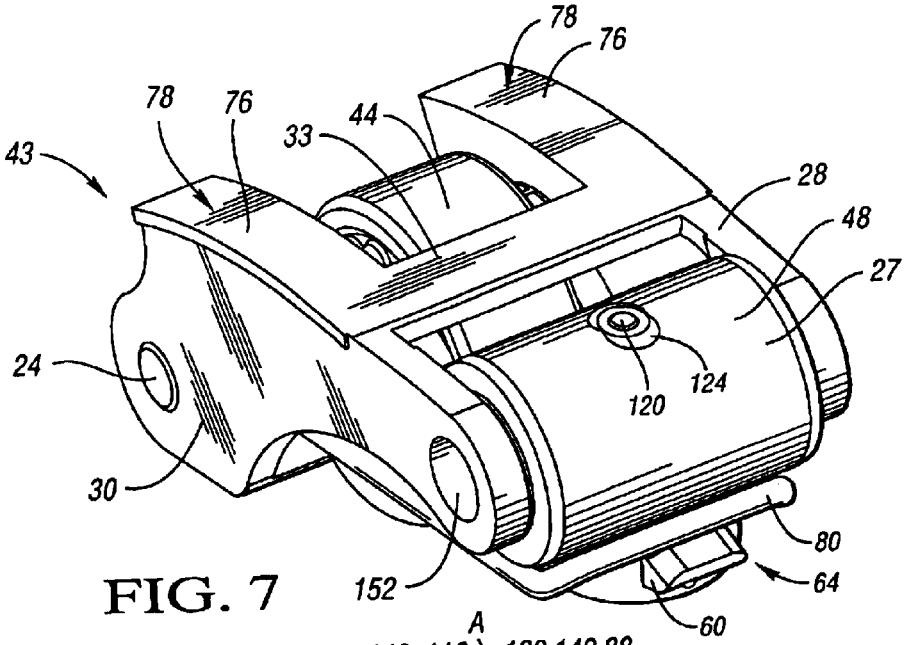
FIG. 7 is a schematic top perspective view from the other end of the rocker arm assembly of FIG. 1 with the torsion spring included.

FIGS. 6 and 7 further depict the rocker arm assembly 15.

Figure 8:
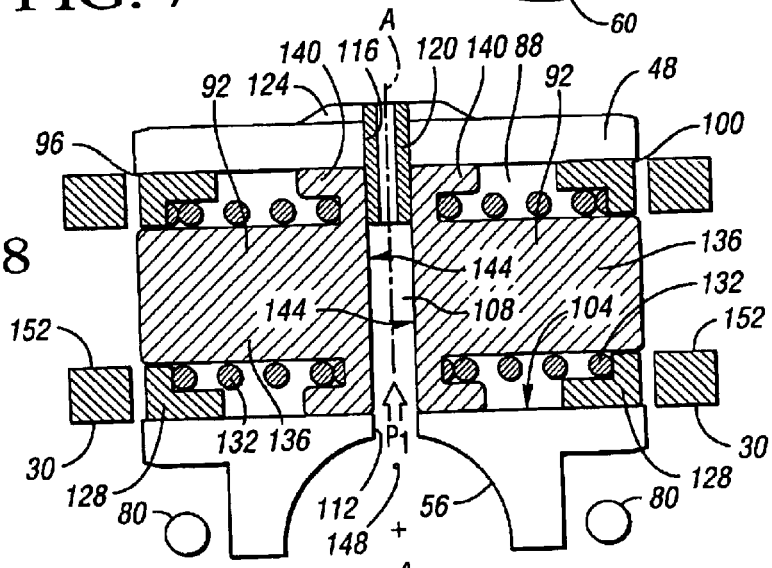
FIG. 8 is a schematic cross sectional view of the locking pin housing of the rocker arm assembly of FIG. 1 with locking pins in a retracted position.

Referring to FIG. 8, a cross-section of the locking pin housing 48 is schematically depicted. The locking pin housing 48 defines a cylindrical locking pin bore 88 extending transversely with respect to the rocker arm assembly and in which two locking pins 92 are located. The bore 88 is "pass through" for ease of manufacture, i.e., it is open on a first end 96 and a second end 100, and extends substantially linearly with a uniform diameter, enabling its formation in a single step such as by drilling. The locking pins engage the inner surface 104 of the bore 88 and are supported by the inner surface 104 for back and forth translation inside the bore 88. An oil supply bore 108 extends through the locking pin housing 48 at a right angle to, and partially coextensive with, the locking pin bore 88. The oil supply bore 108 includes an oil feed hole 112 that functions as a pressure supply aperture, and a stop member aperture 116. The movement of each locking pin 92 is limited by a stop pin 120 (also referred to as a "travel stop member") located at least partially between the locking pins. The stop pin 120 is pressed into (or alternatively threaded into) the stop member aperture 116. The stop member aperture 116 is on the same axis A as the oil feed hole 112, permitting the forming of the oil feed hole and the stop member aperture in a single operation such as by drilling. A boss 124 surrounds the stop member aperture.

An annular spring retainer 128 is pressed into the first end 96 and the second end 100 of the locking pin bore 88. Each spring retainer 128 functions, in part, to limit the travel of one of the locking pins 92. A locking pin return spring 132 is situated between each locking pin 92 and its respective spring retainer 128 so that each locking pin 92 is biased against the stop pin 120 in a retracted position as shown in FIG. 8. Each pin 92 includes a small-diameter portion 136 having a diameter sufficiently small to permit its extension through a spring retainer 128, and a large-diameter portion 140 having a diameter sufficiently large such that the spring 132 or the spring retainer 128 limits its travel through physical part interference. The pins 92 include opposing surfaces 144 in fluid communication with a source of fluid pressure 148, such as an oil supply from a hydraulic lash adjuster, via the oil feed hole 112.

Figure 9:
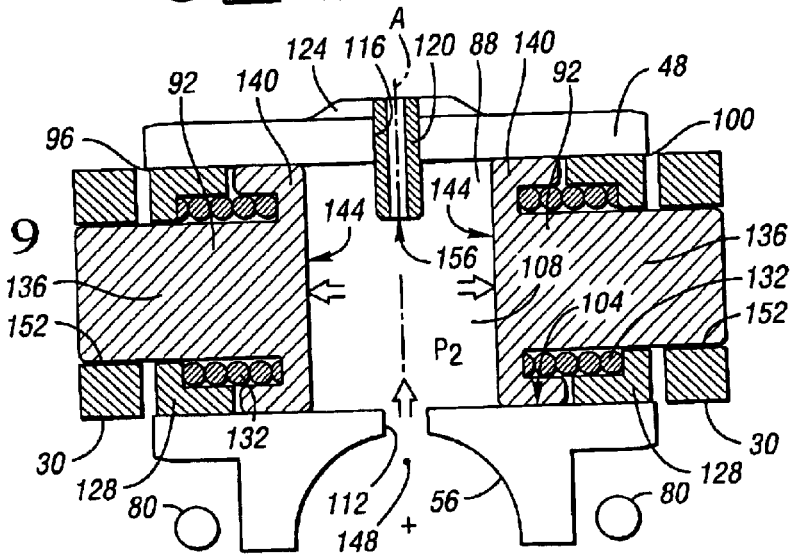
FIG. 9 is a schematic cross sectional view of the locking pin housing of the rocker arm assembly of FIG. 1 with locking pins in an extended position.

An oil supply from a lash adjuster, as depicted at 160 in FIGS. 10–12, is controlled by a solenoid (not shown) such that at predetermined operating points, an engine control module (not shown) can cause the solenoid to switch the oil supply from the lash adjuster from a lower pressure (P1), as depicted in FIG. 8, to a higher pressure (P2), as depicted in FIG. 9, within the locking pin housing 48. When oil pressure (P2) is sufficiently high, as depicted in FIG. 9, the pressure exerted on the locking pins 92 is sufficient to overcome the resistance provided by the springs 132. The pins 92 compress the locking pin return springs 132 until the large diameter portions 140 of the locking pins 92 contact the locking pin spring retainers 128, and the small-diameter portions 136 of the locking pins pass through, or extend across, a small gap between the inner and outer rocker arms and engage locking pin bores 152 in the rail portions 30 of the outer rocker arm. The stop pin 120 has an optional hole 156 through the center which allows for an air bleed and also supplies metered lubrication oil to the roller follower element.

Referring to FIG. 10, the rocker arm assembly 15 is pivotably mounted on a hydraulic lash adjustor 160 and contacts the stem 164 of a valve 166 at the valve stem contact pad. A camshaft 168 includes a low-lift cam 172 in contact with the roller element cam follower, depicted at 44 in FIG. 11. The camshaft 168 also includes two high lift cams 176, one on opposite sides of the low-lift cam 172, in contact with surfaces 78 of respective camshaft interface pads 76. The low-lift cam and the high-lift cams have substantially identical base circle dimensions; the high-lift cam lobes are more protuberant than the low-lift cam lobe. The torsion spring 80 exerts a force on the underside of the camshaft interface pads 76, thereby supporting the outer rocker arm 28 and maintaining contact between the interface pads 76 and the high-lift cams 176. The high-lift cams 176 and the low lift cam 172 contact the rocker arm assembly 15 at their respective base circles in FIG. 10, and the inner rocker arm 27 is in a first position in which the valve 166 is closed.

The geometry of the outer rocker arm 28 is such that no part of the outer rocker arm 28 extends across any line T tangential to either of the interface pad contact surfaces 78. The outer rocker arm 28 is thus designed so that it offers no impediment to the access of a grinding wheel used to process the finished geometry of the high lift camshaft interface pads 76 for improved manufacturability. A single grinding wheel can grind both contact surfaces 78 simultaneously. Grinding the camshaft interface pads 76 such that they are finished in the direction of camshaft rotation provides improved oil control and reduced contact stress.

FIG. 11 is a schematic depiction of the rocker arm assembly 15 operating in low-lift mode. In "normal" (oil pressure supply at P1) operation, or "low lift" mode, the low lift cam lobe 172 causes the inner rocker arm 27 to pivot to a second position in accordance with the low-lift cam's prescribed geometry and thereby open the valve 166 a first predetermined amount. (It should be noted that it is possible to have a different low mode lift profile for each of the adjacent valves in any given cylinder.) The pressure inside the locking pin housing 48 is sufficiently low such that the locking pins 92 are in the retracted position, as depicted in FIG. 8. The high lift lobes 176 are in contact with the outer rocker arm 28 at the high lift camshaft contact pads 76. The larger protuberance of the high-lift cam lobes 176 causes the outer rocker arm 28 to move relative to the inner rocker arm 27 about the pivot shaft 24 in "lost motion" without any impact on the lift event for the valve 166.

In other words, the low pressure oil supply (P1), which enters the inner rocker arm 27 at the pivot interface and is fed through the lash adjuster, is of insufficient pressure to compress the locking pin return springs and cause the locking pins 19 to engage the outer rocker arm 28 in the rocker arm locking pin bores 152. Therefore, the inner rocker arm 27 and the outer rocker arm 28 will be free to move relative to each other. The high lift camshaft lobes 176 acting upon the camshaft interface pads 76 on either side of the roller 44 will not cause the valve 166 to travel the full lift as defined by the high-lift cam lobe 176 profiles. The packaging and configuration of the lost motion spring 80 improves the potential of the lost motion assembly, i.e., the outer rocker arm assembly, to remain stable at high engine speeds.

Referring again to FIGS. 2 and 3, the inner rocker arm 27 has a relief geometry feature 180 between the roller element cam follower 44 and the locking pin housing 48. The relief geometry feature 180 provides clearance for the outer rocker arm upper tie bar portion during "lost motion" of the outer rocker arm while in low lift mode. The relief geometry feature 180 is a concavity in the surface of the inner rocker arm 27 that is sufficiently positioned with respect to the upper tie bar such that at least a portion of the upper tie bar is within the concavity during at least a portion of the relative movement between the inner rocker arm and the outer rocker arm. This allows the tie bar geometry to be contained within the envelope of the rocker arm, as opposed to adding this feature to the rear of the arm, for improved packagability of the design. Those skilled in the art may find it preferable to omit an upper tie bar and employ a second lower tie bar (not shown) with a corresponding relief geometry feature in the inner rocker arm between the pivot interface 56 and the roller element cam follower 44 to provide clearance for the second lower tie bar.

FIG. 12 is a schematic depiction of the rocker arm assembly in high-lift mode. The engine control module (not shown) has instructed the solenoid (not shown) to increase the oil pressure in the housing 48 sufficiently such that the locking pins 92 compress the retention springs and are in the extended position. The inner rocker arm 27 and the outer rocker arm 28 are not free to pivot relative to one another about the pivot shaft 24. Rather, the inner rocker arm is forced to pivot to a third position in accordance with the high-lift cam lobe geometry. The inner rocker arm 27 causes the valve stem 164 to move a greater distance in the third position compared to the second, or low-lift, position, thereby causing the valve to open a second predetermined amount greater than the first predetermined amount. The low lift cam will lose contact with the roller element at any time the high lift profile causes more valve lift than the low lift profile.

While the best modes for carrying out the invention have been described in detail, those familiar with the art to which this invention relates will recognize various alternative designs and embodiments for practicing the invention within the scope of the appended claims.

What is claimed is:

1. A rocker arm assembly comprising:

an outer rocker arm characterized by two rail portions spaced a distance apart from one another and defining an open space therebetween, each of the rail portions having a high-lift cam follower thereon for engagement with a high-lift cam and defining a locking pin hole;

an inner rocker arm movably connected to the outer rocker arm such that at least a portion of the inner rocker arm is in the open space, the inner rocker arm having a low-lift cam follower thereon for engagement with a low-lift cam;

a locking pin housing on the inner rocker arm at least partially within the open space and having a locking pin bore formed therein; and a first locking pin and a second locking pin selectively movable within the bore between an extended position in which the first and the second locking pins extend into the locking pin holes thereby to prevent relative movement between the inner rocker arm and the outer rocker arm, and a retracted position in which the first and second locking pins do not extend into the locking pin holes.

2. The rocker arm assembly of claim 1, wherein the outer rocker arm is movable relative to the inner rocker arm when the first and second locking pins are in the retracted position; wherein the outer rocker arm includes a tie bar portion operatively interconnecting the two rail portions; and wherein the inner rocker arm surface is characterized by a concavity sufficiently positioned with respect to the tie bar portion to provide clearance for the tie bar portion during relative movement between the inner rocker arm and the outer rocker arm.

3. The rocker arm assembly of claim 1, further comprising a pivot shaft about which the inner rocker arm and the outer rocker arm are pivotably movable with respect to one another; wherein the inner rocker arm is characterized by a pivot shaft retention boss that is a unitary part of the inner rocker arm and through which the pivot shaft extends; and wherein each rail portion of the outer rocker arm defines an aperture through which the pivot shaft extends.

4. The rocker arm assembly of claim 1, wherein each of the high-lift cam followers is characterized by a cam follower surface configured for contact with a high-lift cam; and wherein the rocker arm assembly further comprises a torsion spring operatively connected to the inner rocker arm and the outer rocker arm such that the torsion spring biases the outer rocker arm in a direction to maintain contact between the cam follower surfaces and a high-lift cam.

5. The rocker arm assembly of claim 4, wherein the outer rocker arm is characterized by at least one surface generally opposite from the cam follower surfaces; wherein the inner rocker arm includes a surface that contacts the torsion spring and against which the torsion spring exerts a force; wherein the torsion spring extends alongside the inner rocker arm on two sides thereof, winds about the pivot shaft between the inner rocker arm and each of the outer rocker arm rail portions, and extends from the pivot shaft to said at least one surface generally opposite from the high-lift cam contact surfaces.

6. The rocker arm assembly of claim 1, wherein the locking pin housing bore is characterized by a substantially constant diameter.

7. The rocker arm assembly of claim 1, wherein the inner rocker arm defines a pressure supply aperture through which the first and the second locking pins may be in fluid communication with a source of fluid pressure; and wherein the first locking pin and the second locking pin are sufficiently configured and arranged within the locking pin housing such that the pins are in the retracted position when the fluid pressure exerted against the pins is less than a predetermined amount; and wherein the pins are in the extended position when the fluid pressure exerted against the pins is greater than the predetermined amount.

8. The rocker arm assembly of claim 7, further comprising a first spring retainer in a first end of the locking pin bore, a second spring retainer in a second end of the locking pin bore, a first spring between the first spring retainer and the first locking pin; and a second spring between the second spring retainer and the second locking pin; and a travel stop member positioned between the first locking pin and the second locking pin; the first spring biasing the first locking pin against the travel stop member, and the second spring biasing the second locking pin against the travel stop member.

9. The rocker arm assembly of claim 8, wherein the inner rocker arm is characterized by a pivot interface for receiving a portion of a lash adjustor on which the inner rocker arm is pivotable; wherein the pressure supply aperture is sufficiently located with respect to the pivot interface to provide fluid communication between the lash adjustor and the two locking pins; wherein the locking pin housing defines an aperture in which the travel stop member is retained; and wherein the aperture in which the travel stop member is retained and the pressure supply aperture are characterized by a common axis.

10. The rocker arm assembly of claim 9, wherein the aperture in which the travel stop member is retained and the pressure supply aperture are formed in a single drilling operation.

11. The rocker arm assembly of claim 1, wherein the locking pin bore is formed in a single drilling operation.

12. The rocker arm assembly of claim 1, wherein each of the high-lift cam followers is characterized by a cam follower surface configured for contact with a high-lift cam; and wherein no part of the outer rocker arm extends across any line tangential to the cam follower surfaces.

13. A valvetrain comprising:

a camshaft having a low-lift cam and two high-lift cams, the two high-lift cams being on opposite sides of the low-lift cam;

an outer rocker arm characterized by two rail portions spaced a distance apart from one another and defining an open space therebetween, each of the rail portions having a high-lift cam follower thereon in contact with one of the two high-lift cams and defining a locking pin hole;

an inner rocker arm movably connected to the outer rocker arm such that at least a portion of the inner rocker arm is in the open space, the inner rocker arm having a low-lift cam follower thereon in contact with the low-lift cam;

a locking pin housing on the inner rocker arm at least partially within the open space and having a locking pin bore formed therein; and a first locking pin and a second locking pin selectively movable within the bore between an extended position in which the first and the second locking pins extend into the locking pin holes thereby to prevent relative movement between the inner rocker arm and the outer rocker arm, and a retracted position in which the first and second locking pins do not extend into the locking pin holes.

14. The valvetrain of claim 13, wherein the outer rocker arm is movable relative to the inner rocker arm when the first and second locking pins are in the retracted position; wherein the outer rocker arm includes a tie bar portion operatively interconnecting the two rail portions; and wherein the inner rocker arm surface is characterized by a concavity sufficiently positioned with respect to the tie bar portion to provide clearance for the tie bar portion during relative movement between the inner rocker arm and the outer rocker arm.

15. The valvetrain of claim 13, further comprising a pivot shaft about which the inner rocker arm and the outer rocker arm are pivotably movable with respect to one another; wherein the inner rocker arm is characterized by a pivot shaft retention boss that is a unitary part of the inner rocker arm and through which the pivot shaft extends; and wherein each rail portion of the outer rocker arm defines an aperture through which the pivot shaft extends.

16. The valvetrain of claim 13, wherein each of the high-lift cam followers is characterized by a cam follower surface with which one of the high-lift cams is in contact; and wherein the rocker arm assembly further comprises a torsion spring operatively connected to the inner rocker arm and the outer rocker arm such that the torsion spring biases the outer rocker arm in a direction to maintain contact between the contact surfaces and the high-lift cams.

17. The valvetrain of claim 16, wherein the outer rocker arm is characterized by at least one surface generally opposite from the cam follower surfaces; wherein the inner rocker arm includes a curved protrusion defining a concave surface; wherein the torsion spring contacts and exerts a force against the concave surface; wherein the torsion spring extends alongside the inner rocker arm on two sides thereof, winds about the pivot shaft between the inner rocker arm and each of the outer rocker arm rail portions, and extends from the pivot shaft to said at least one surface generally opposite from the high-lift cam contact surfaces.

18. The valvetrain of claim 13, further comprising a hydraulic lash adjustor operatively connected to the inner rocker arm such that the inner rocker arm is pivotable about the lash adjustor; wherein the inner rocker arm defines an aperture through which the lash adjustor is in fluid communication with the first locking pin and the second locking pin, wherein the lash adjustor is configured to exert a selectively variable fluid pressure on the first and second locking pins; and wherein the first and second locking pins are in the retracted position when the fluid pressure is below a predetermined amount and in the extended position when the fluid pressure exceeds the predetermined amount.

19. The valvetrain of claim 18, further comprising a first annular spring retainer in a first end of the locking pin bore; a second annular spring retainer in a second end of the locking pin bore; a first spring between the first spring retainer and the first locking pin; and a second spring between the second spring retainer and the second locking pin; and a travel stop member positioned between the first locking pin and the second locking pin; the first spring biasing the first locking pin against the travel stop member, and the second spring biasing the second locking pin against the travel stop member.

20. A rocker arm assembly comprising:

an outer rocker arm, the outer rocker arm characterized by two rail portions spaced a distance apart from one another and defining an open space therebetween, each of the rail portions having a high-lift cam follower thereon and defining a locking pin hole;

an inner rocker arm pivotably connected to the outer rocker arm such that at least a portion of the inner rocker arm is in the open space, the inner rocker arm having a low-lift cam follower thereon;

a locking pin housing on the inner rocker arm at least partially within the open space and having a locking pin bore formed therein; a first locking pin and a second locking pin selectively movable within the bore;

a first annular spring retainer in a first end of the locking pin bore, a second annular spring retainer in a second end of he locking pin bore, a first spring between the first spring retainer and the first locking pin; a second spring between the second spring retainer and the second locking pin; and a travel stop member positioned between the first locking pin and the second locking pin; the first spring biasing the first locking pin against the travel stop member, and the second spring biasing the second locking pin against the travel stop member;

wherein the first and second locking pins are selectively movable between an extended position in which the first and the second locking pins extend through the first and second annular spring retainers and into the locking pin holes thereby to prevent relative movement between the inner rocker arm and the outer rocker arm, and a retracted position in which the first and second locking pins do not extend into the locking pin holes.

* * * * *